US007175174B2

(12) United States Patent
Terao et al.

(10) Patent No.: US 7,175,174 B2
(45) Date of Patent: Feb. 13, 2007

(54) WAITING TRAY FOR SHEET PROCESSING TRAY

(75) Inventors: Yasunobu Terao, Tagata-gun (JP); Mikio Yamamoto, Tagata-gun (JP); Tomomi Iijima, Mishima (JP); Reiji Murakami, Yokohama (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,392

(22) Filed: Dec. 10, 2004

(65) Prior Publication Data

US 2006/0066032 A1 Mar. 30, 2006

(30) Foreign Application Priority Data

Sep. 28, 2004 (JP) ..... 2004-281771

(51) Int. Cl.
*B65H 39/04* (2006.01)
*B65H 29/34* (2006.01)

(52) U.S. Cl. ..... 270/58.12; 270/58.08; 270/58.11; 270/58.14; 270/58.18; 399/410; 271/189; 271/190; 271/191; 271/192

(58) Field of Classification Search ..... 270/58.08, 270/58.11, 58.12, 58.14, 58.18; 399/410; 271/189, 190, 191, 192
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,898,374 A 2/1990 Vermaat
5,098,074 A 3/1992 Mandel et al.
5,282,611 A 2/1994 Ueda et al.
5,285,249 A 2/1994 Mahoney
5,289,251 A 2/1994 Mandel et al.

(Continued)

FOREIGN PATENT DOCUMENTS

JP 62-008965 A 1/1987

(Continued)

OTHER PUBLICATIONS

U.S. Appl. No. 11/008,122, filed Dec. 10, 2004, Sasahara.

(Continued)

*Primary Examiner*—Patrick Mackey
*Assistant Examiner*—Leslie A. Nicholson, III
(74) *Attorney, Agent, or Firm*—Foley & Lardner LLP

(57) ABSTRACT

A waiting tray is provided at some midpoint of a conveying path, and a sheet is caused to be in a waiting state when a post-process is required. Before performing the post-process, a processing tray receives the sheet conveyed from the waiting tray and the sheet conveyed from a conveying path without passing through the waiting tray. At this point, waiting tray parts are moved toward a direction in which the waiting tray parts are separated from each other, and a bundle of paper starts fall-down. When the bundle of paper falls down, the waiting tray parts are moved toward the direction in which the waiting tray parts are brought close to each other, and an alignment member performs alignment in a transverse direction of the bundle of paper.

17 Claims, 12 Drawing Sheets

U.S. PATENT DOCUMENTS

| | | | | |
|---|---|---|---|---|
| 5,435,544 | A | 7/1995 | Mandel | |
| 5,451,037 | A | 9/1995 | Lundstrom | |
| 5,628,502 | A | 5/1997 | Amarakoon | |
| 5,676,517 | A | 10/1997 | Lotz | |
| 5,709,376 | A | 1/1998 | Ushirogata | |
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A | 7/2000 | Altfather | |
| 6,142,461 | A | 11/2000 | Asao et al. | |
| 6,231,039 | B1 | 5/2001 | Chung | |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,450,934 | B1 * | 9/2002 | Coombs | 493/383 |
| 6,581,922 | B2 | 6/2003 | Kuwata et al. | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 | 4/2004 | Abbata et al. | |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 2002/0047233 | A1 | 4/2002 | Coombs et al. | |
| 2002/0163119 | A1 | 11/2002 | Kawata | |
| 2003/0057625 | A1 | 3/2003 | Kuwata et al. | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 2001-89009 | A | 4/2001 |
| JP | 2001089009 | A * | 4/2001 |
| JP | 2003-081517 | A | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,567, filed Dec. 10, 2004, Terao et al.
Y. Terao, et al., Notice of Allowance and Fee(s) Due, U.S. App. No. 11/008,124, Sep. 30 2005, 9 pages.
Y. Terao, et al., Notice of Allowance and Fee(s) Due, U.S. App. No. 11/008,132 Oct. 6, 2005, 9 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,227, Feb. 9, 2006, 9 pgs.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 9, 2006, 9 pgs.
Y. Terao et al., U.S. PTO Office Action, U.S. Appl. No. 11/085,243, Jan. 26, 2006, 6 pgs.
Y. Terao et al., U.S. PTO Office Action, U.S. Appl. No. 11/085,244, Feb. 9, 2006, 7 pgs.
Y. Terao et al., U.S. PTO Notice of Allowance, U.S. Appl. No. 11/085,243, Jan. 5, 2006, with attached Notice of Withdrawal from Issue dated Jan. 10, 2006, 10 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,295, Jan. 5, 2006, 11 pages.
Y. Terao et al., U.S. PTO Office Action, U.S. Appl. No. 11/008,350, Jan. 26, 2006, 12 pages.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,224, Nov. 21, 2005, 10 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Nov. 30, 2005, 9 pages.
Y. Terao et al., U.S. PTO Office Action, U.S. Appl. No. 11/008,290, Nov. 30, 2005, 9 pages.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/085,226, Jul. 20, 2006, 12 pages.

Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147, Jul. 7, 2006, 4 pgs.
Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,248, Jul. 5, 2006, 15 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao, et al., Notice of Allowance and Fee(s) Due, U.S. Appl. No. 11/008,122, Jul. 26, 2006, 8 pgs.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/085,241, Jun. 26, 2006, 10 pages.
Y. Terao et al., Notice of Allowance and Fee(s) Due, U.S. Appl. No. 11/085,243, Jun. 26, 2006, 10 pages.
Y. Terao et al., U.S. PTO Office Action, U.S. Appl. No. 11/008,295, Jun. 23, 2006, 14 pgs.
Y. Terao et al., U.S. PTO Office Action, U.S. Appl. No. 11/008,132, Jun. 9, 2006, with attached Notice of Withdrawal from Issue dated May 30, 2006, 11 pgs.
K. Sasahara et al., U.S. PTO Office Action, U.S. Appl. No. 11/008,122, Apr. 19, 2006, 10 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 1, 2006, 16 pages.
Y. Terao et al., Notice of Allowance and Fee(s) Due, U.S. Appl. No. 11/008,349, May 2, 2005, 9 pages.
Y. Terao et al., U.S. PTO Office Action, U.S. Appl. No. 11/008,224, Apr. 21, 2006, 12 pages.
Y. Terao et al., U.S. PTO Office Action, U.S. Appl. No. 11/008,257, Apr. 28, 2006, 13 pages.
Y. Terao et al., U.S. PTO Office Action, U.S. Appl. No. 11/008,271, Apr. 25, 2006, 14 pages.
Y. Terao et al., U.S. PTO Office Action, U.S. Appl. No. 11/008,294, May 5, 2006 13 pages.
Y. Terao et al., U.S. PTO Office Action, U.S. Appl. No. 11/008,299, May 5, 2006, 12 pages.
Y. Terao et al., Notice of Allowance and Fee(s) Due, Appl. No. 11/008,295, Sep. 21, 2006, 7 pages.
Y. Terao et al., Notice of Allowance and Fee(s) Due, Appl. No. 11/008,350, Sep. 21, 2006, 7 pages.
Y. Terao et al., U.S. PTO Office Action, Appl. No. 11/008,381, Aug. 23, 2006, 17 pages.
Y. Terao et al., U.S. PTO Office Action, Appl. No. 11/008,567, Aug. 21, 2006, 14 pages.
Y. Terao et al., Notice of Allowance and Fee(s) Due, Appl. No. 11/008,222, Aug. 31, 2006, 12 pgs.
Y. Terao et al., Notice of Allowance and Fee(s) Due, Appl. No. 11/008,299, Sep. 6, 2006, 9 pgs.
Y. Terao et al. U.S. PTO Office Action, Appl. No. 11/008,131, Oct. 17, 2006, 15 pages.
Y. Terao et al. U.S. PTO Office Action, Appl. No. 11/008,132, Nov. 24, 2006, 16 pages.
Y. Terao et al. U.S. PTO Office Action, Appl. No. 11/008,224, Nov. 17, 2006, 13 pages.
Y. Terao et al. U.S. PTO Office Action, Appl. No. 11/008,230, Nov. 13, 2006, 17 pages.
Y. Terao et al. U.S. PTO Office Action, Appl. No. 11/008,294, Oct. 24, 2006, 11 pages.
Y. Terao et al. U.S. PTO Office Action, Appl. No. 11/085,625, Nov. 21, 2006, 13 pages.
Y. Terao et al. Notice of Allowance and Fee(s) Due, Appl. No. 11/008,257, Oct. 24, 2006, 11 pages.

* cited by examiner

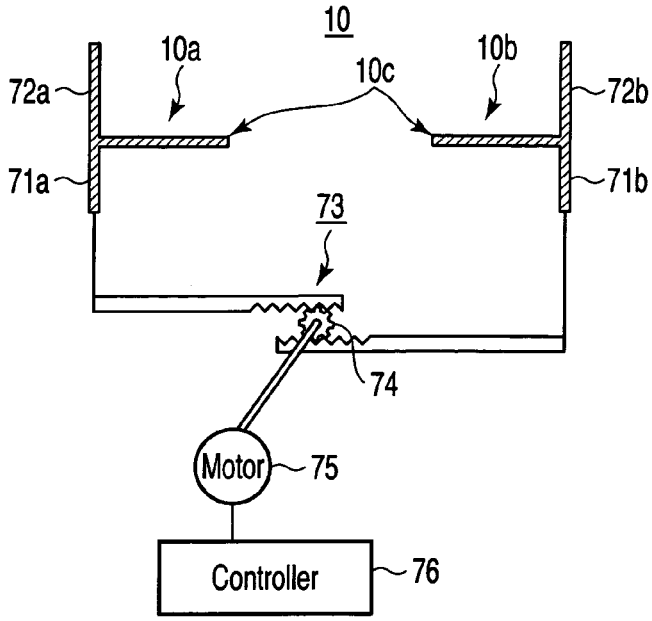
FIG. 18
FIG. 19A
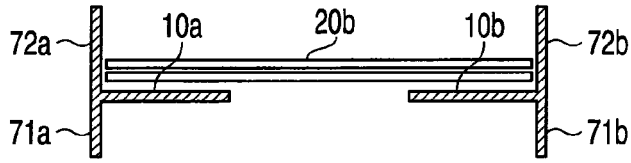
FIG. 19B
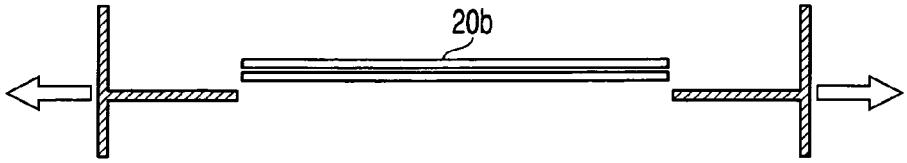
FIG. 19C
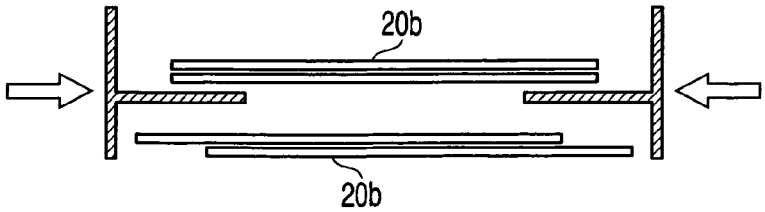
FIG. 19D
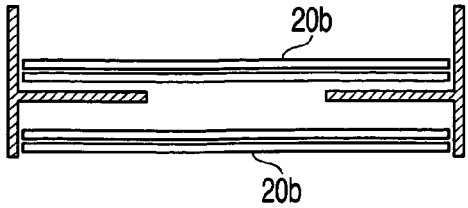

WAITING TRAY FOR SHEET PROCESSING TRAY

CROSS-REFERENCE TO RELATED APPLICATIONS

This application is based upon and claims the benefit of priority from prior Japanese Patent Application No. 2004-281771, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function peripheral (MFP).

2. Description of the Related Art

An apparatus called "finisher" is known, which receives printed sheets supplied from an MFP and staples them together. In the finisher, the sheets supplied from the MFP are sequentially conveyed to a tray and stapled by a stapler, forming a bundle of sheets. The bundle of sheets is ejected from the apparatus onto a storage tray.

Because the process of binding the sheets with stapler exists in a post-process in the finisher, a second tray previously temporarily accommodates a bundle of sheets, and then the bundle of sheets is caused to fall down on a first tray to staple the bundle of sheets with a stapler. The finisher, in which an alignment plate is provided in the first tray to perform transverse alignment of the second tray, is well known (Jpn. Pat. Appln. KOKAI Publication No. 2001-89009).

However, in the finisher described in Jpn. Pat. Appln. KOKAI Publication No. 2001-89009, because mechanical parts are large in number, the apparatus can not sufficiently be miniaturized.

BRIEF SUMMARY OF THE INVENTION

An object of the invention is to provide a sheet post-process apparatus which performs the alignment in a transverse direction of the sheet without difficulty.

According to an aspect of the invention, there is provided a sheet post-process apparatus comprising: a plurality of rollers configured to receive and convey a sheet conveyed from an MFP main body; a waiting tray which is provided at some midpoint of a conveying path, and is configured to cause the sheet conveyed from the roller to be in a waiting state when a post-process is required, the waiting tray being freely opened and closed in a transverse direction orthogonal to a sheet conveying direction, an alignment member being vertically provided on a lower side surface of a loading surface on which the sheet is loaded; an open and close mechanism configured to open and close the waiting tray in a transverse direction; a processing tray configured to receive the sheet conveyed from the waiting tray and the sheet conveyed from a conveying path without passing through the waiting tray before performing the post-process; an alignment mechanism configured to align the sheets on the processing tray to form a bundle of sheets; a post-process mechanism configured to perform the post-process of the bundle of sheets aligned on the processing tray; a sheet conveying unit configured to convey the bundle of sheets to which the post-process has been performed from the processing tray; and a storage tray configured to load the conveyed bundle of sheets thereon.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 18 is a view showing a cross section of the waiting tray and a drive mechanism in the post-process apparatus; and FIGS. 19A to 19D are a view which explain aligning sheets at their transverse edges by the waiting tray in the post-process apparatus respectively.

DETAILED DESCRIPTION OF THE INVENTION

An embodiment of this invention will be described, with reference to the accompanying drawings.

Figure 1:
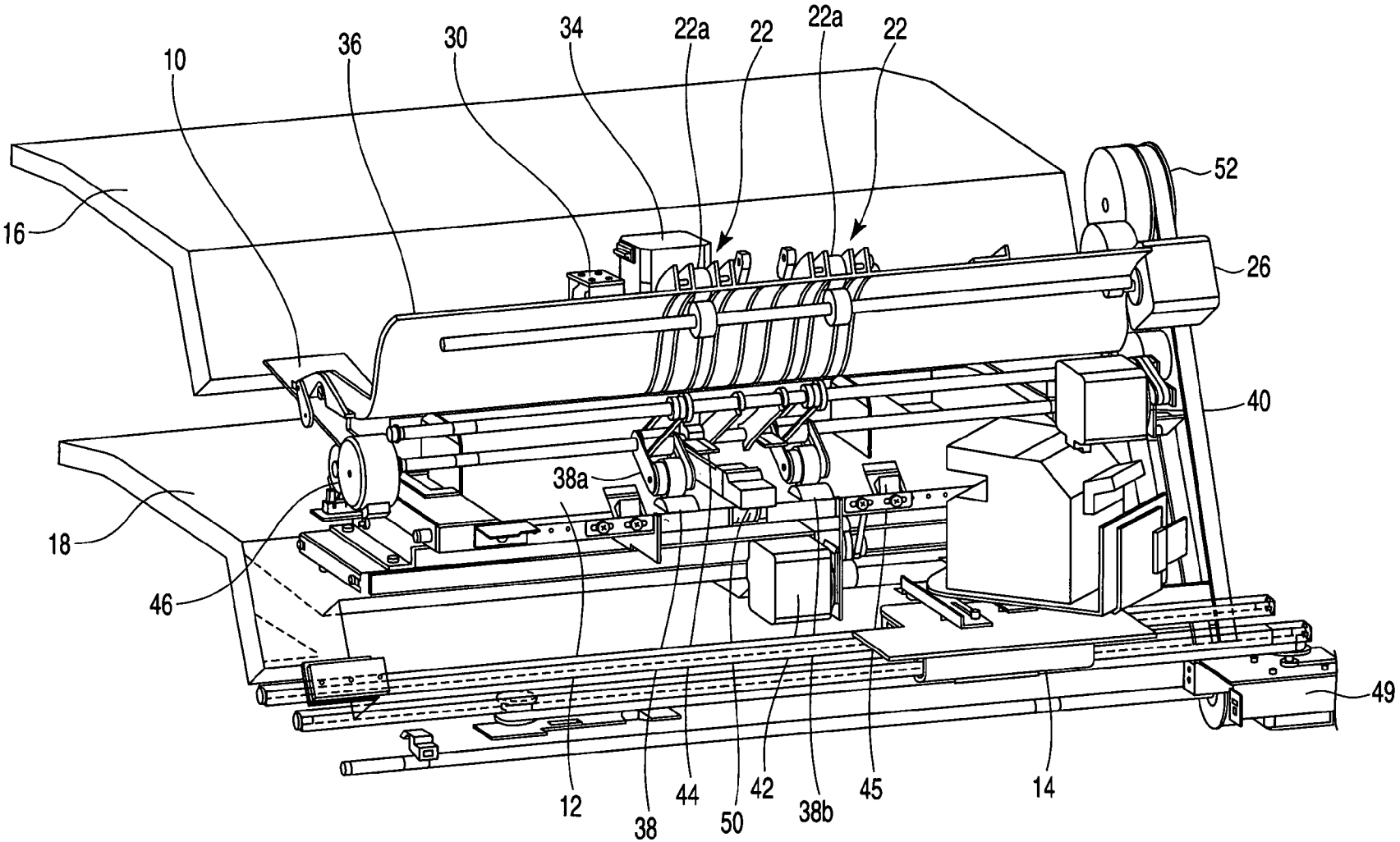
FIG. 1 is a perspective view of a post-process apparatus according to this invention.
Figure 2:
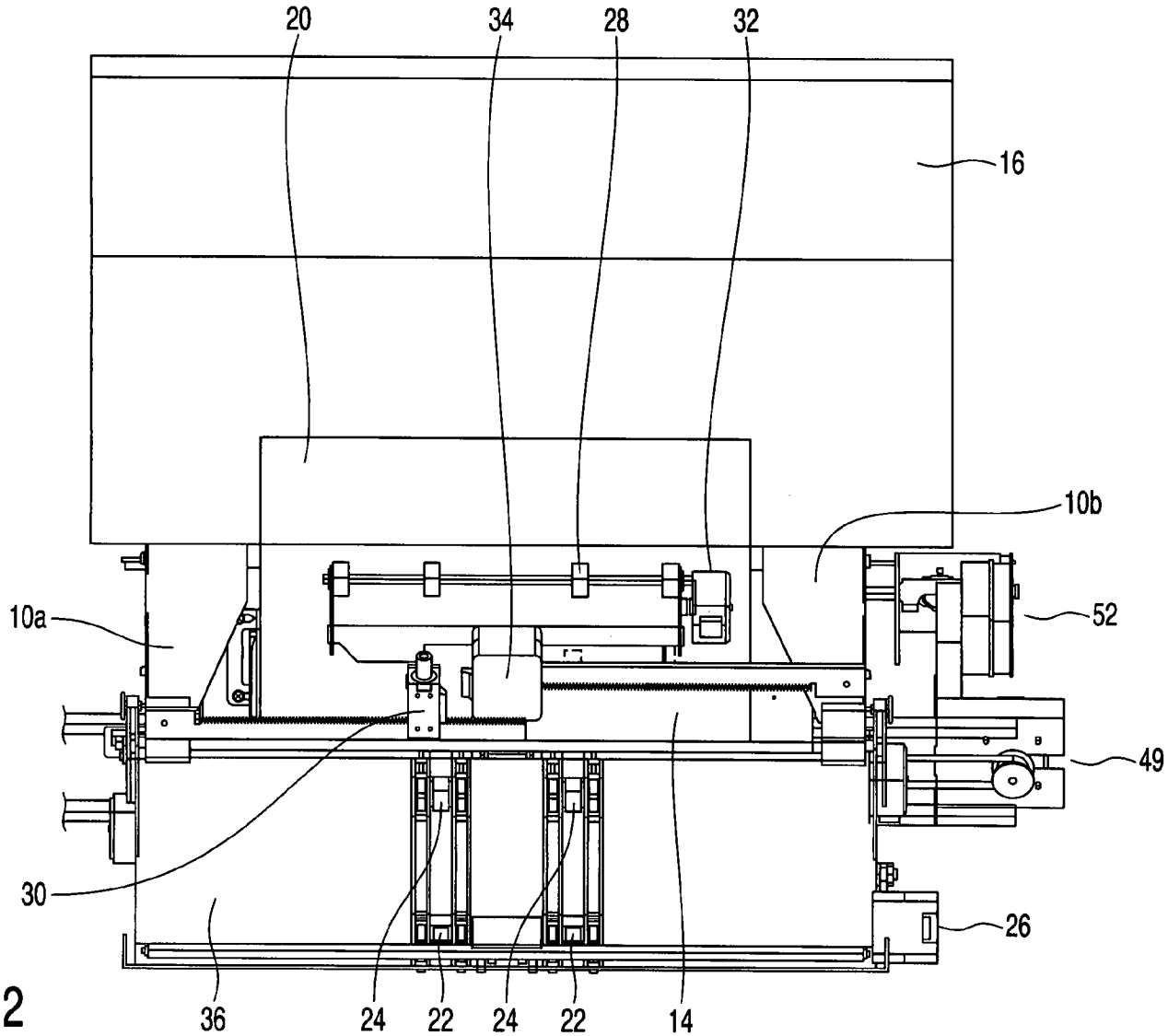
FIG. 2 is a top view of the post-process apparatus according to the invention.

FIG. 1 is a perspective view of a sheet post-process apparatus according to this invention. FIG. 2 is a top view of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP 1 (see FIG. 7) and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

The waiting tray 10 comprises two tray parts 10*a* and 10*b*. The tray parts 10*a* and 10*b* can move from left to right, and vice verse. While an interval between the tray parts 10*a* and 10*b* is narrowed, the waiting tray 10 can receive sheets. Waiting-tray rollers 28, a waiting-roller drive 30 and a waiting-roller motor 32 are provided. The waiting-tray rollers 28 align sheets on the tray parts 10*a* and 10*b* while both tray parts remain in the narrowed position. The waiting-tray rollers 28 can move up and down when they are driven and controlled by the waiting-roller drive 30. The waiting-roller motor 32 rotates the waiting-tray rollers 28.

Figure 3:
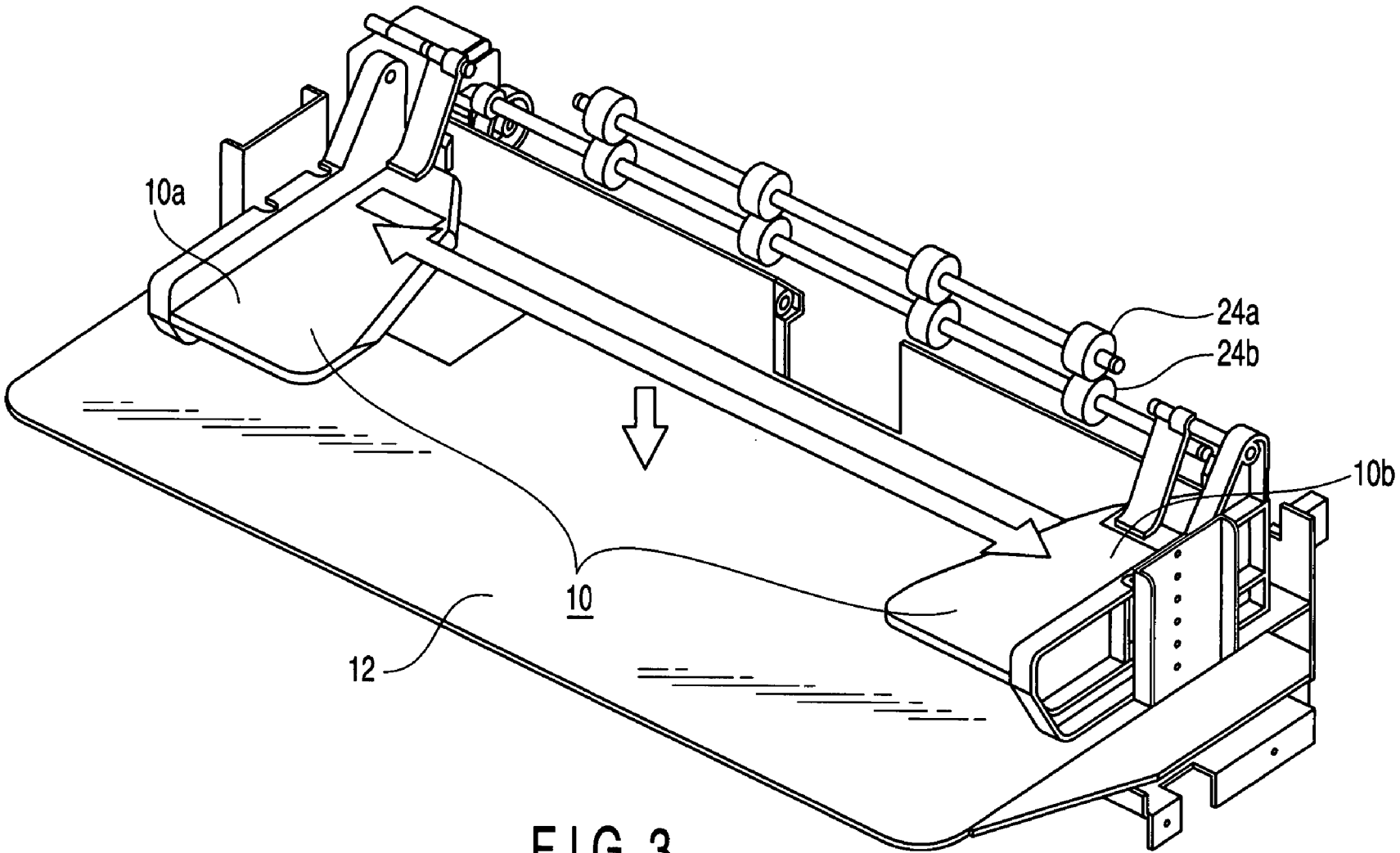
FIG. 3 is a perspective view illustrating how the waiting tray of the post-process apparatus performs its function.

When the number of sheets 20 stacked on the waiting tray 10 reaches a prescribed value, a waiting-tray motor 34 drives the waiting-tray parts 10*a* and 10*b* to an opened position as is illustrated in FIG. 3. The sheets 20 fall onto the processing tray 12, due to gravity. This event is known as "active drop".

Widths in the paper 20 conveying directions of the waiting tray 10 and the processing tray 12 are smaller than the width in the conveying direction of the paper 20. When the paper falls down on the processing tray 12, the paper 20 is loaded across the processing tray 12 and the first storage tray 16 (shown in FIG. 2).

Thus, the width along the conveying direction of the paper in the post-process apparatus can be decreased.

Referring to FIG. 18, a cross section and an open and close mechanism of the waiting tray parts 10*a* and 10*b* will be described. As shown in FIG. 18, a pair of alignment members 71*a* and 71*b* is vertically provided on the lower side surfaces of sheet loading surfaces 10*c* in the waiting tray 10. A pair of wall members 72*a* and 72*b* is vertically provided on both sides of surfaces of the sheet loading surfaces 10*c* in the waiting tray parts 10*a* and 10*b*.

The alignment members 71*a* and 71*b* are connected to both ends of a rack and pinion mechanism 73. A stepping motor 75 controls the rotation of a pinion gear 74, and controller 76 controls the rotation of the stepping motor 75.

The sheet post-process apparatus has a paper guide 36, which guides sheets from the MFP 1 to the waiting tray 10 and thence to the processing tray 12. The paper guide 36 has a paper-pass ceiling.

Figure 4:
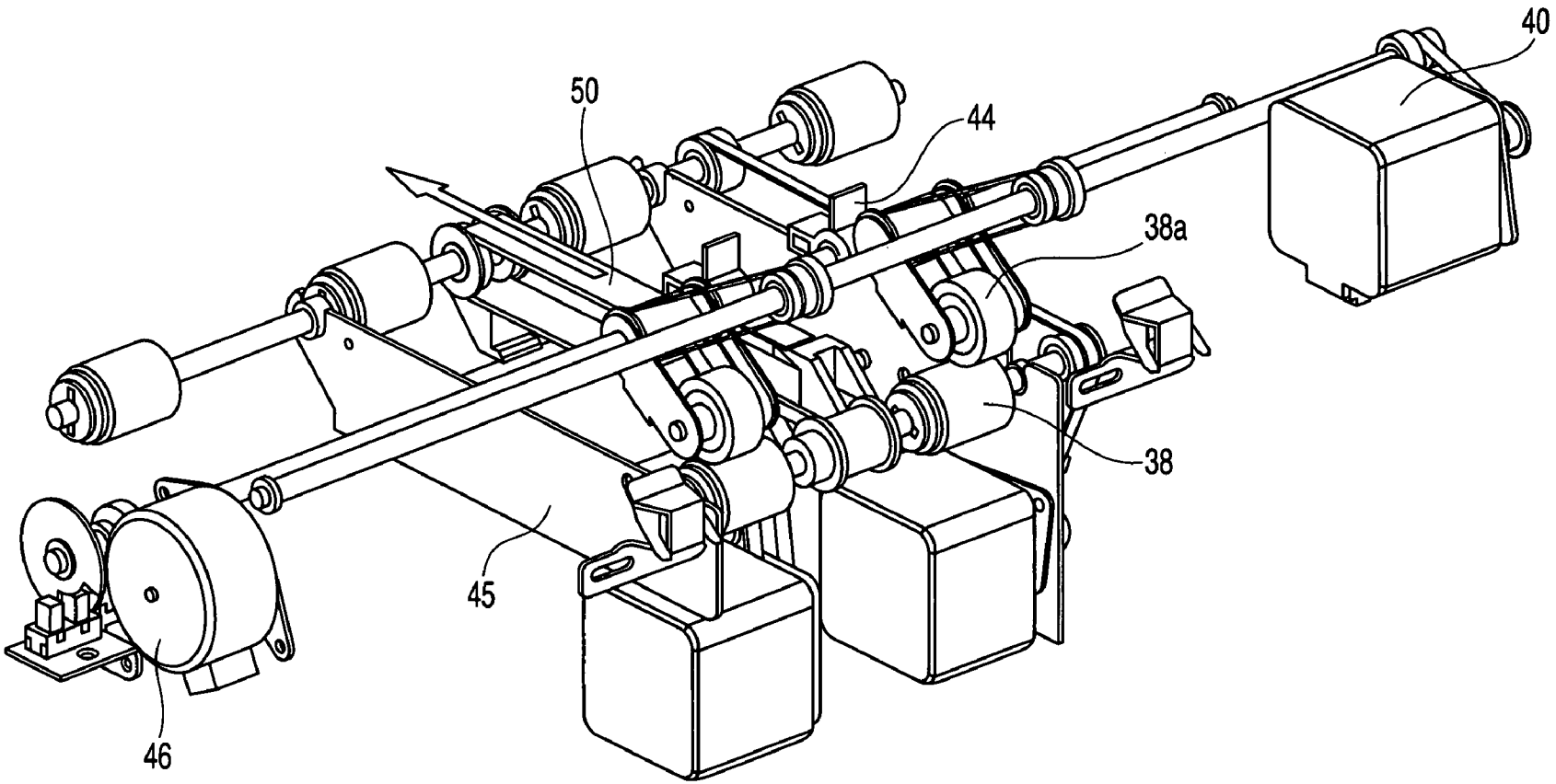
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 6:
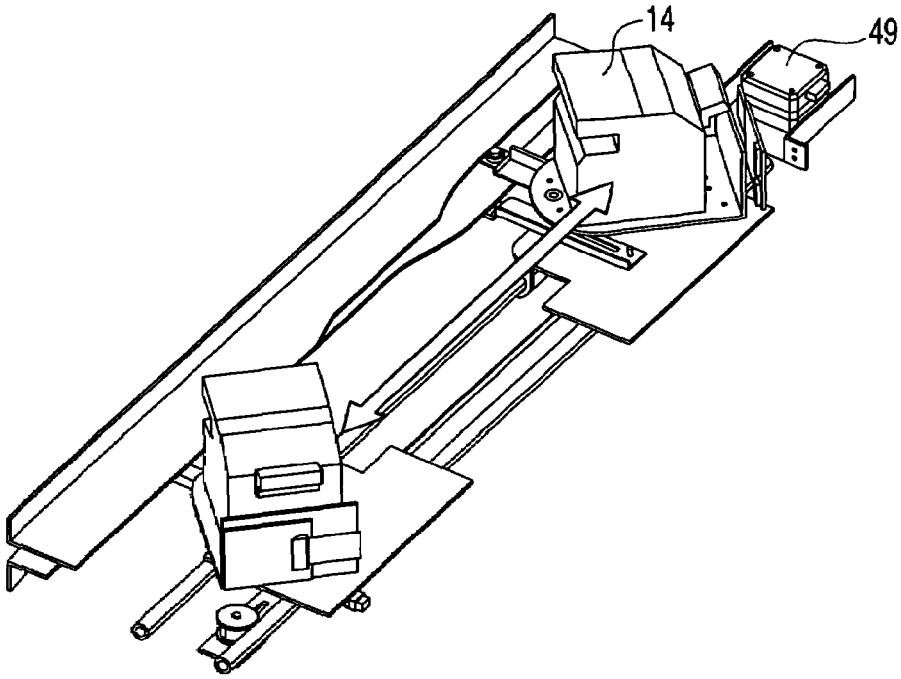
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 moves the tray 16 or 18 to a predetermined upper position.

How the post-process apparatus according to this invention operates will be explained with reference to FIGS. 7 to 18.

Figure 7:
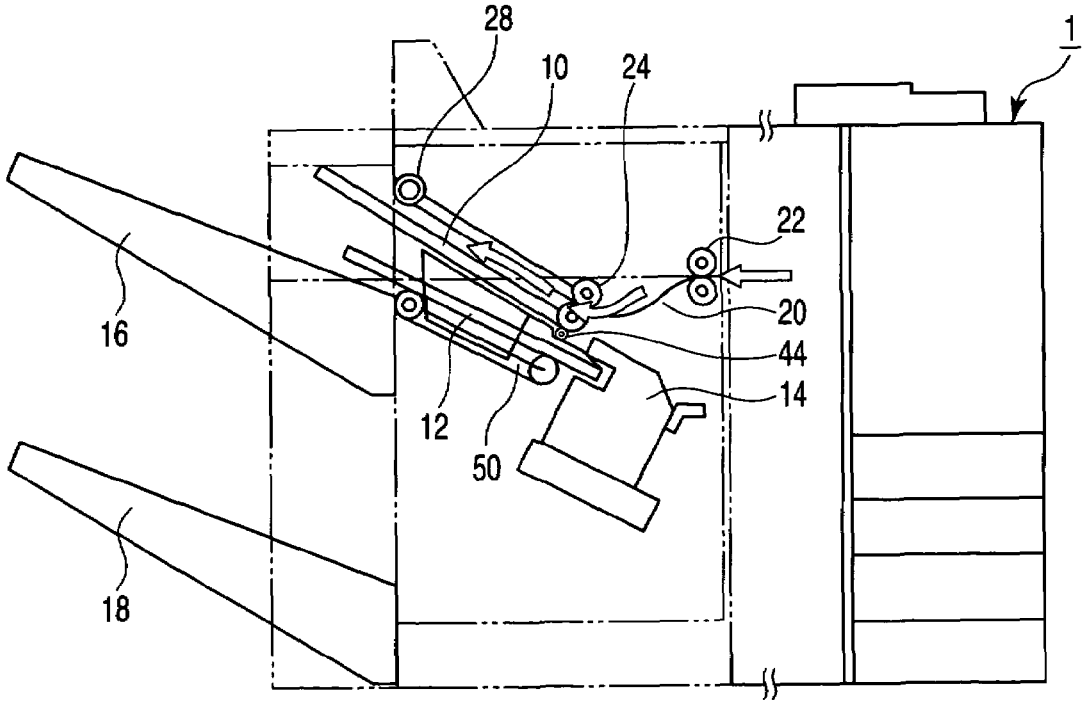
FIG. 7 is a sectional view of the post-process apparatus, showing how the first sheet moves from the input rollers to the sheet-feeding roller.

As FIG. 7 shows, a sheet 20 conveyed from the MFP 1 is moved from the input rollers 22 to the sheet-feeding rollers 24, in the direction of the arrow.

Figure 8:
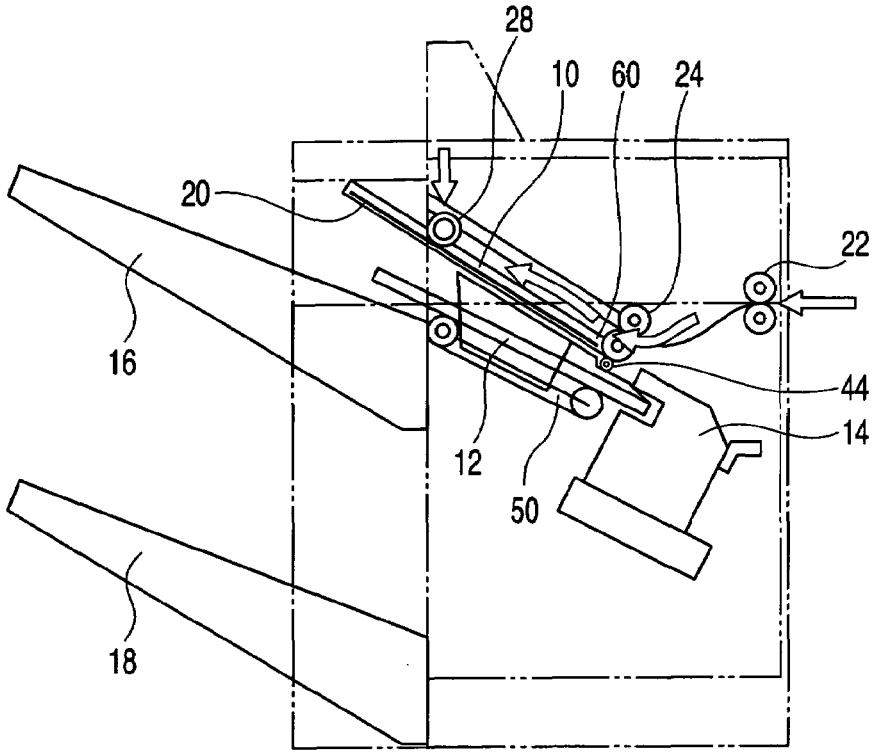
FIG. 8 is a sectional view of the apparatus, explaining how the first sheet moves from the sheet-feeding rollers to the waiting tray.

As is illustrated in FIG. 8, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 9:
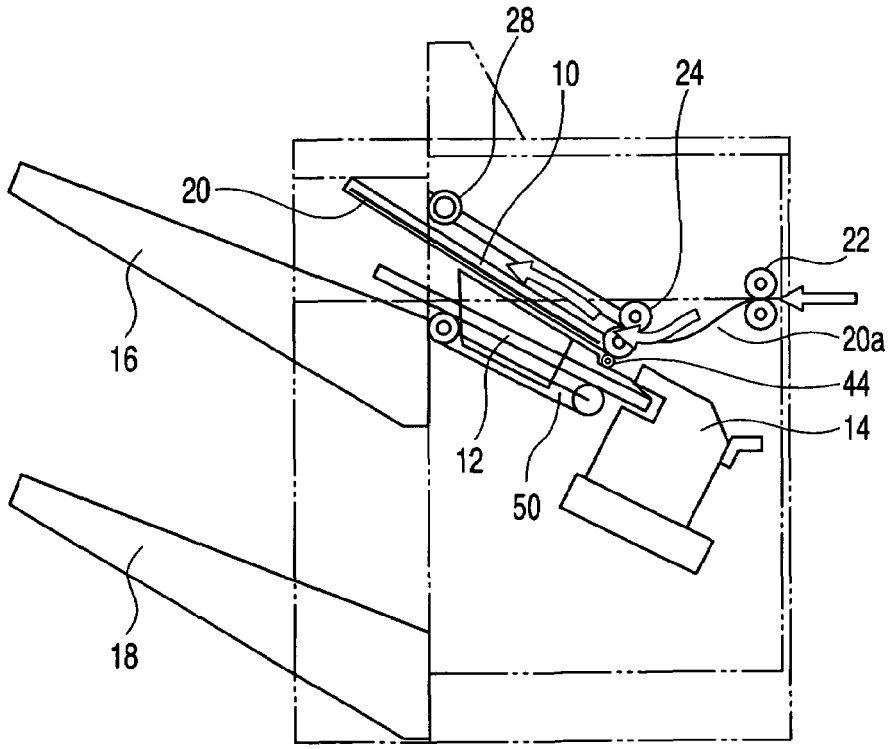
FIG. 9 is a sectional view of the apparatus, explaining how the second sheet moves from the sheet-feeding rollers to the waiting tray.

As FIG. 9 depicts, the waiting-tray rollers 28 moves up to receive the second sheet 20*a*.

Figure 10:
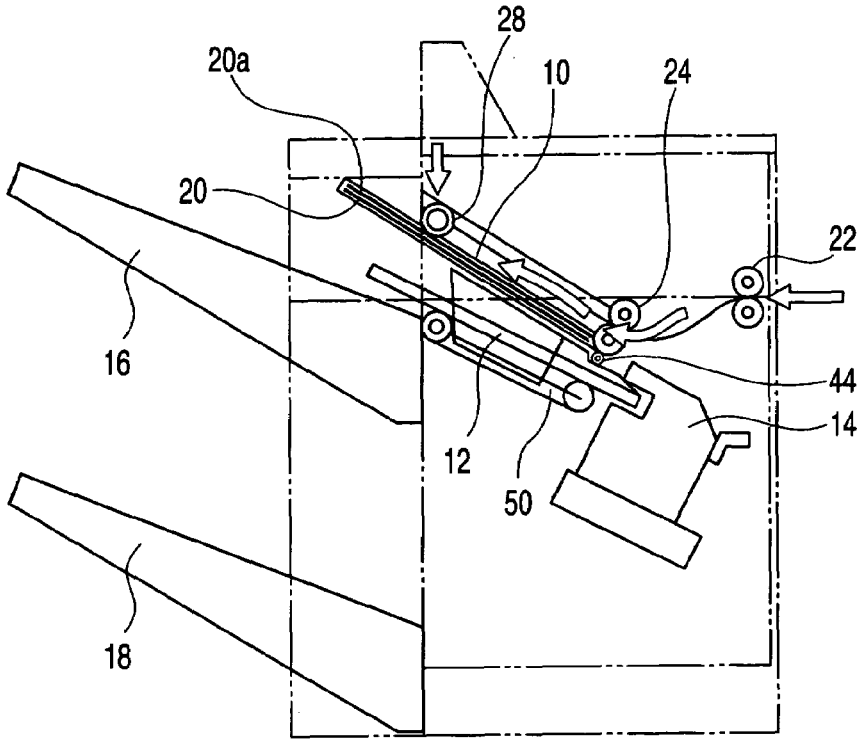
FIG. 10 is a sectional view of the post-process apparatus, showing how the waiting-tray rollers operate.

As FIG. 10 shows, the second sheet 20 is conveyed to the waiting tray 10. The waiting-tray rollers 28 move down, aligning the trailing edge of the second sheet 20*a* at the rear end 60 of the waiting tray 10. Thus, a bundle 20*b* of two sheets 20 and 20*a* is formed in the waiting tray 10.

Figure 11:
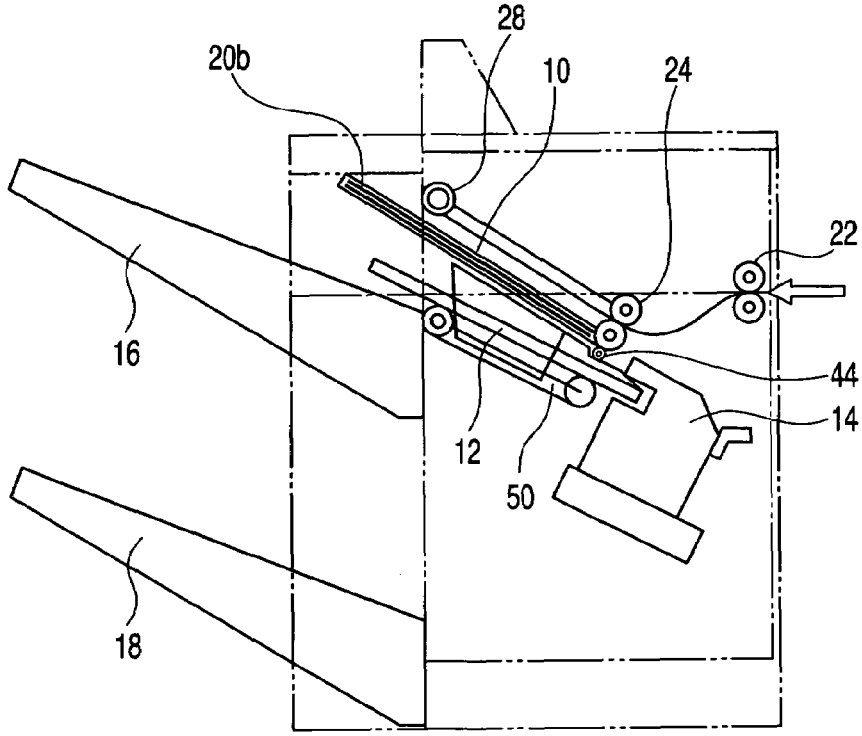
FIG. 11 is another sectional view of the apparatus, illustrating how the waiting-tray rollers operate.
Figure 12:
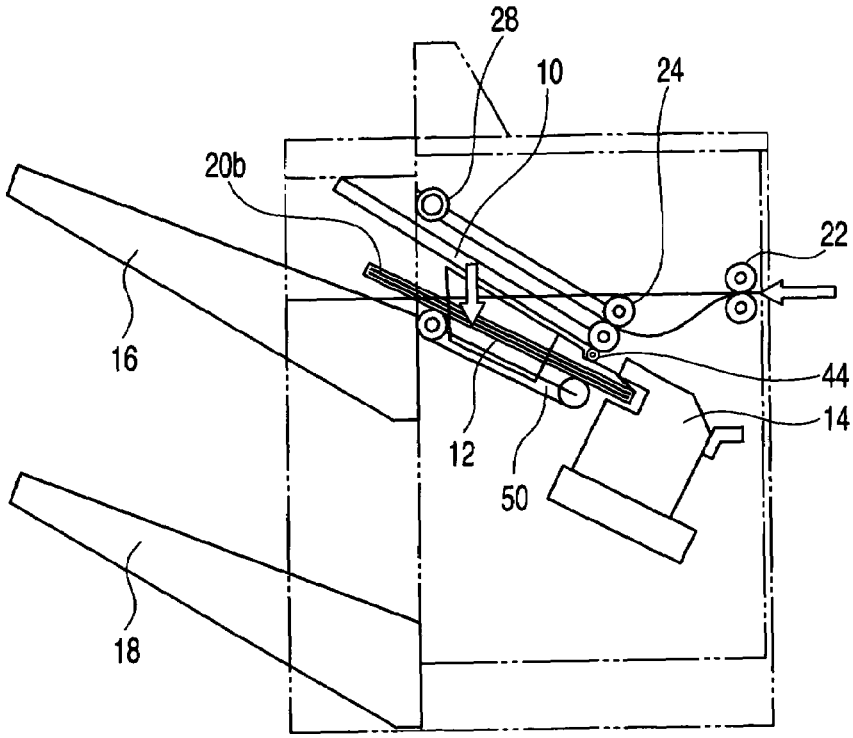
FIG. 12 is a sectional view of the apparatus, explaining how an active drop is carried out.

As FIG. 11 show, the waiting-tray rollers 28 move upwards. Then, the waiting-tray parts 10*a* and 10*b* move to the opened position as is illustrated in FIG. 3. The active drop is therefore performed as shown in FIG. 12. The bundle 20*b* is conveyed to the processing tray 12.

Referring to FIG. 19, a procedure in which the bundle of paper 20*b* loaded on the waiting tray 10 falls down on the processing tray 12 will be described in detail. At first, as shown in FIG. 19A, the bundle of paper 20*b* is loaded on the waiting tray parts 10*a* and 10*b*. As shown in FIG. 19B, the controller 76 controls the stepping motor 75 to move the waiting tray parts 10*a* and 10*b* toward the direction in which the waiting tray parts 10*a* and 10*b* are separated from each other, and the bundle of paper 20*b* starts the fall-down.

When the bundle of paper 20*b* falls down, as shown in FIG. 19C, the controller 76 controls the stepping motor 75 to move the waiting tray parts 10*a* and 10*b* toward the direction in which the waiting tray parts 10*a* and 10*b* are brought close to each other.

In the procedure in which the bundle of paper 20 falls down, since the waiting tray parts 10*a* and 10*b* are controlled toward the direction in which the waiting tray parts 10*a* and 10*b* are brought close to each other, even if the alignment in the transverse direction of the bundle of paper 20*b* is confused as shown in FIG. 19C, the alignment in the transverse direction of the bundle of paper 20*b* can be secured by the alignment members 71*a* and 71*b* as shown in FIG. 19D.

In controlling the waiting tray parts 10*a* and 10*b* toward the direction in which the waiting tray parts 10*a* and 10*b* are brought close to each other, it is possible that the waiting tray parts 10*a* and 10*b* are brought close to each other while the alignment members 71*a* and 71*b* are slightly moved by repeating the normal rotation and the reverse rotation of the stepping motor 75. Therefore, a contact surface of the bundle of paper is decreased in a coefficient of kinetic friction, and the transverse alignment can easily be performed.

Figure 13:
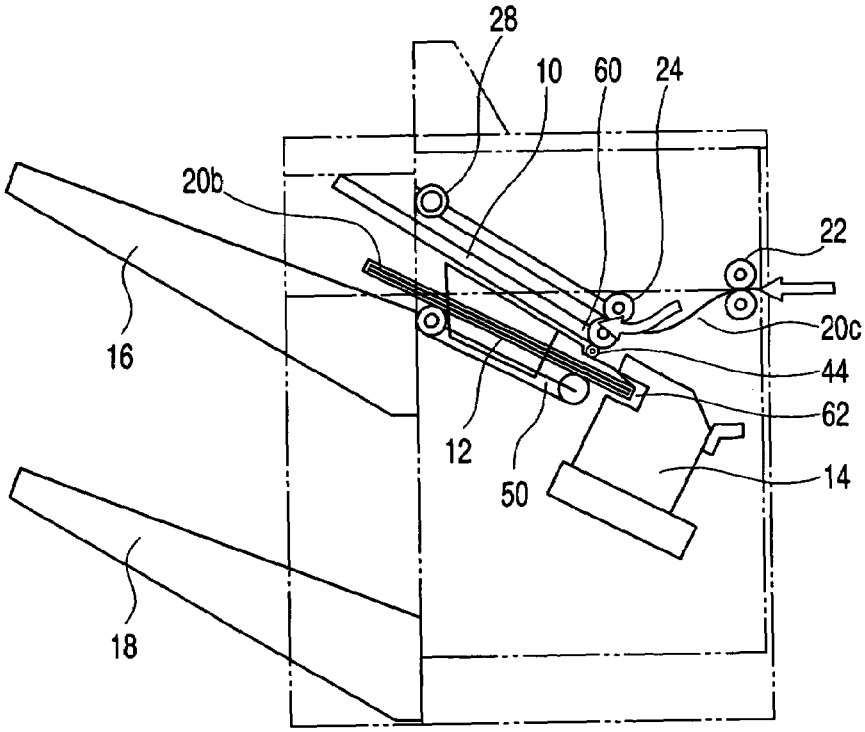
FIG. 13 is a sectional view of the apparatus, explaining how the third sheet is conveyed.

Thereafter, as shown in FIG. 13, the third sheet 20*c* and some following sheets are conveyed from the sheet-feeding rollers 24 to the processing tray 12, not through the waiting tray 10. These sheets are laid, one after another, upon the bundle 20*b* of two sheets. A bundle 21, which consists of the prescribed number of sheets, is formed on the processing tray 12. As the sheets including the third sheet 20 are sequentially laid on the bundle 20*b*, the longitudinal-alignment rollers 38 and the transverse-alignment mechanism 47 align the sheets at their longitudinal edges and transverse edges.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

Figure 14:
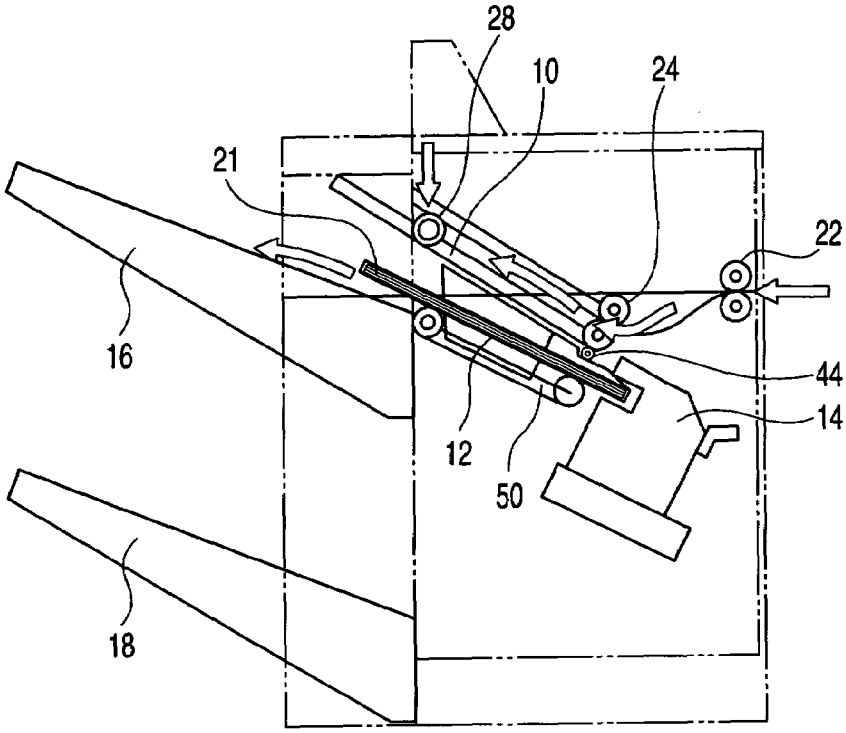
FIG. 14 is a sectional view of the apparatus, illustrating how the stapler operates.
Figure 15:
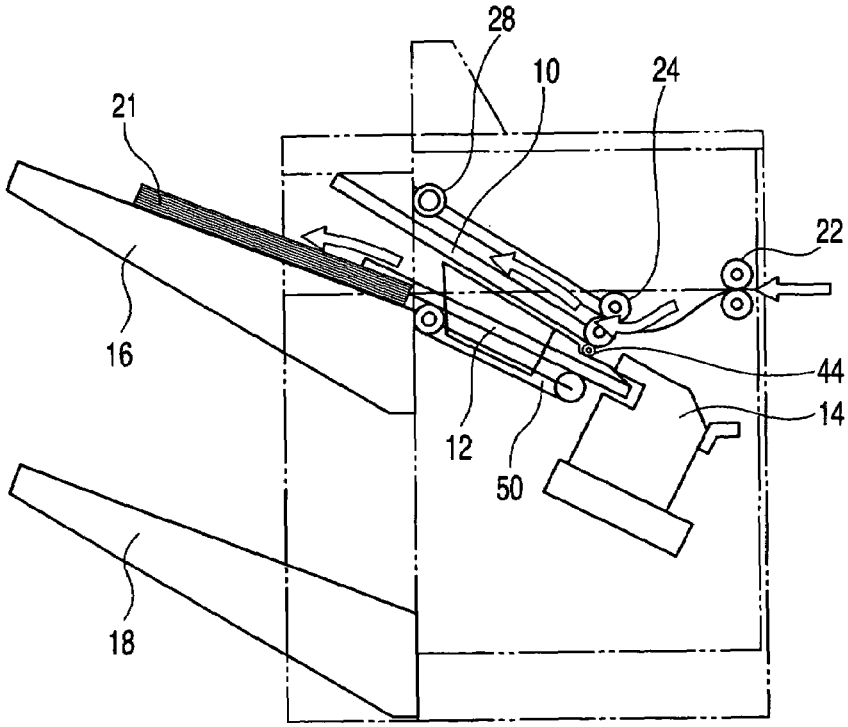
FIG. 15 is a sectional view of the apparatus, explaining how a bundle of sheets moves between the processing tray and the storage tray.

As FIG. 14 shows, the stapler 14 staples the bundle 21 of sheets. Then, the transport mechanism 50 transports the bundle 21 to the storage tray 16 as illustrated in FIG. 15. Thus, the post-process ends.

Figure 16:
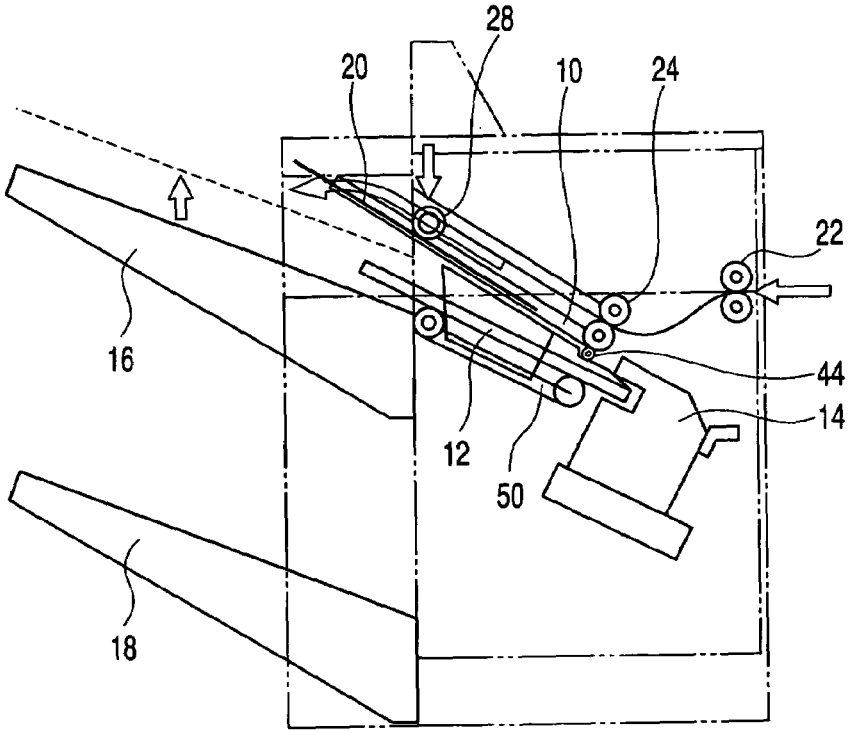
FIG. 16 is a sectional view of the apparatus, illustrating how sheets move from the waiting tray to the storage tray.
Figure 17:
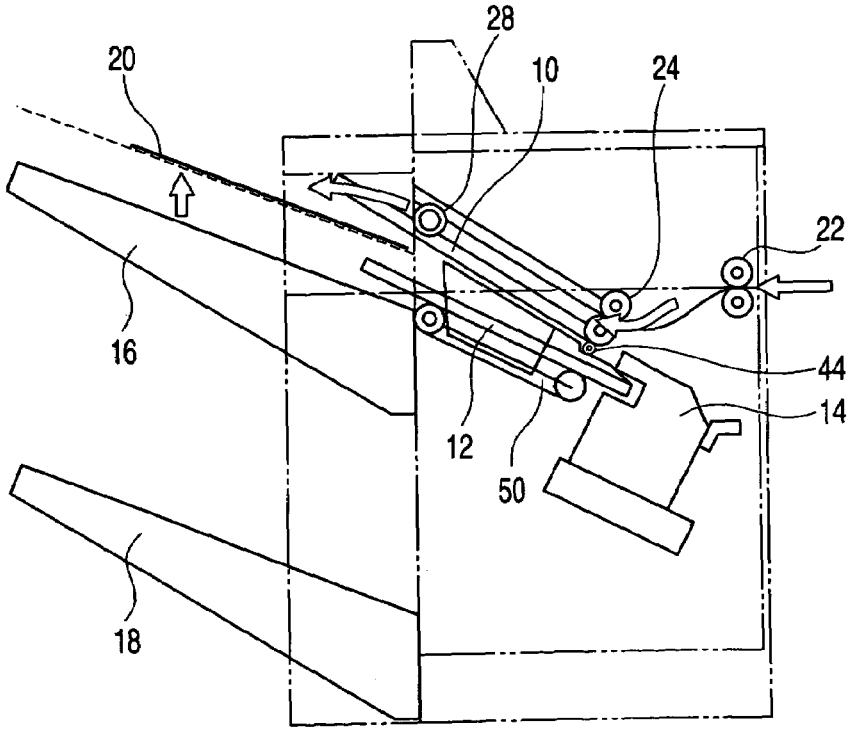
FIG. 17 is a sectional view of the apparatus, explaining how the position of the storage tray is changed.

If the sheets need not undergo the post-process, they are not conveyed to the processing tray 12. They are ejected from the waiting tray 10 onto the first storage tray 16 as show in FIGS. 16 and 17. As FIG. 16 shows, the sheets supplied form the MFP 1 are sequentially conveyed to the first storage tray 16 via the input rollers 22, sheet-feeding rollers 24 and waiting tray 10. The waiting-tray rollers 28 move down, serving to convey sheets 20. As depicted in FIG. 17, the storage-tray driving unit 52 lifts the first storage tray 16 a little and receives the sheets coming from the waiting tray 10.

Figure 5:
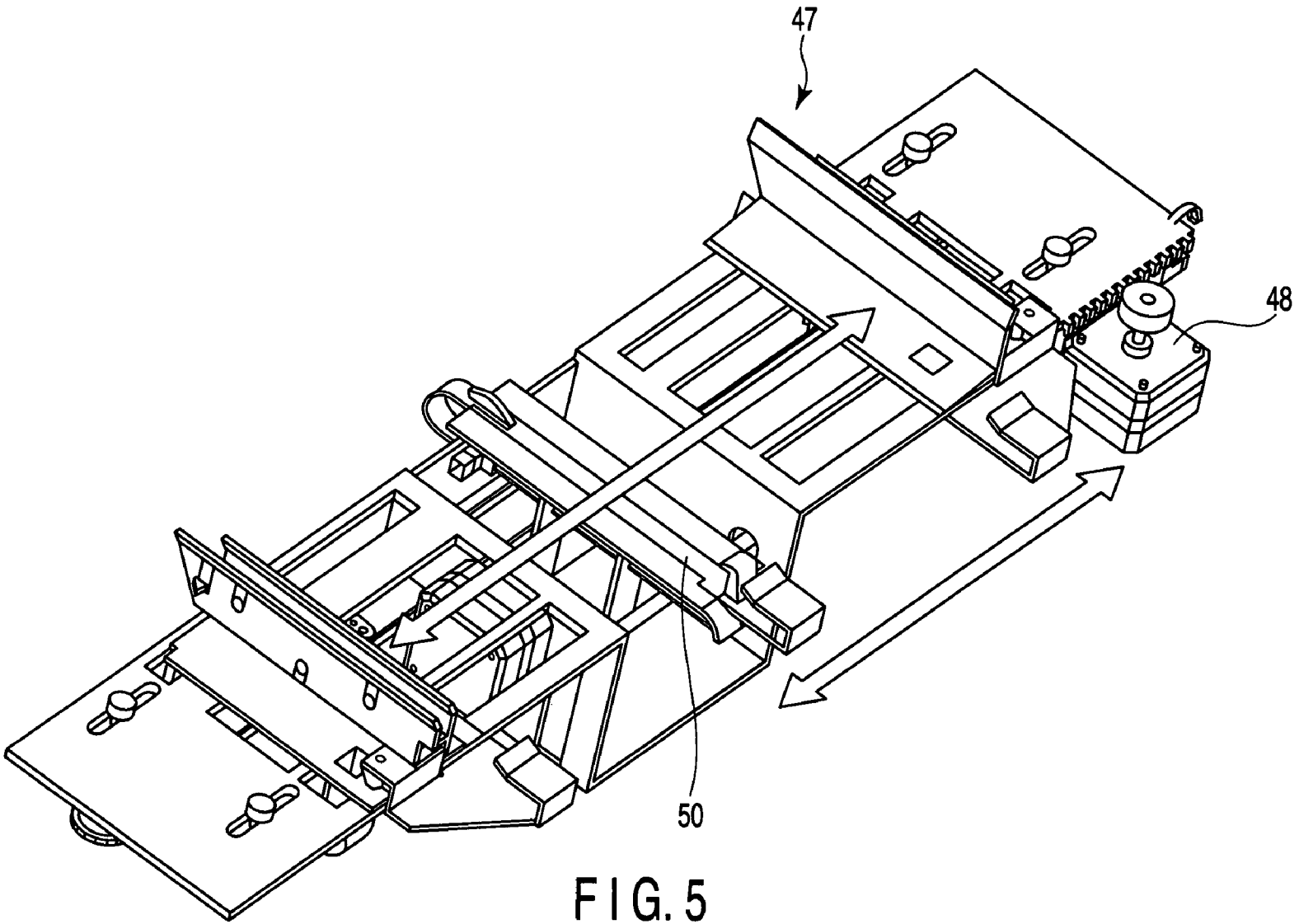
FIG. 5 is a perspective view showing the mechanism for aligning sheets at their transverse edges.

As shown in FIG. 5, it is also possible that a transverse alignment mechanism 47 is provided in the processing tray 12.

In the embodiment, the paper is received while the waiting tray parts 10*a* and 10*b* are narrowed. However, it is possible that the paper is received while the waiting tray parts 10*a* and 10*b* are closed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed, the waiting tray being integrally formed with upper and lower alignment members and bottom portions, wherein the sheets on the waiting tray lie substantially parallel to the bottom portions and substantially perpendicular to the upper alignment members to align the sheets;

a processing tray which holds the bundle of sheets before post-processing; and an open and close mechanism configured to open and close the waiting tray in a transverse direction orthogonal to a sheet conveying direction, wherein the open and close mechanism is a rack and pinion mechanism, and wherein the lower alignment members extend beyond the bottom portions in a vertical direction to align the bundle of sheets on the processing tray.

2. The sheet post-process apparatus according to claim 1, wherein transverse alignment of the bundle of sheets on the processing tray is performed by the lower alignment members.

3. The sheet post-process apparatus according to claim 1, wherein widths in the sheet conveying direction of the waiting tray and the processing tray are smaller than the width of the sheets in the sheet conveying direction.

4. The sheet post-process apparatus according to claim 1, wherein the open and close mechanism is connected to the lower alignment members.

5. The sheet post-process apparatus according to claim 1, wherein the processing tray holds the aligned sheets from the waiting tray and other sheets forming the bundle of sheets before the bundle of sheets is post processed.

6. The sheet post-process apparatus according to claim 5, wherein the processing tray holds the other sheets forming the bundle of sheets that are conveyed via the conveying path without being conveyed to the waiting tray before the bundle of sheets is post-processed.

7. The sheet-post process apparatus according to claim 6, further comprising a post-process mechanism that performs a post-process on the bundle of sheets on the processing tray.

8. The sheet post-process apparatus according to claim 7, further comprising a storage tray which holds the bundle of sheets post-processed by the post-process mechanism and conveyed from the processing tray.

9. The sheet post-process apparatus according to claim 8, wherein the sheets are loaded across the processing tray and the storage tray when the sheets are conveyed to the processing tray.

10. A sheet post-process apparatus, comprising:

a plurality of rollers which receive sheets from a multi-function peripheral and convey the sheets forward;

a waiting tray which is provided in a conveying path and holds some of the sheets conveyed from the rollers when a bundle of sheets needs to be post-processed, the waiting tray being integrally formed with upper and lower alignment members and bottom portions, wherein the sheets on the waiting tray lie substantially parallel to the bottom portions and substantially perpendicular to the upper alignment members to align the sheets;

a rack and pinion mechanism that opens and closes the waiting tray in a transverse direction orthogonal to a sheet conveying direction; and a processing tray which holds the bundle of sheets before post-processing;

11. The sheet post-process apparatus according to claim 10, wherein transverse alignment of the bundle of sheets on the processing tray is performed by the lower alignment members.

12. The sheet post-process apparatus according to claim 10, wherein widths in a sheet conveying direction of the waiting tray and the processing tray are smaller than the width of the sheets in the sheet conveying direction.

13. The sheet post-process apparatus according to claim 10, wherein the processing tray holds the aligned sheets from the waiting tray and other sheets forming the bundle of sheets before the bundle of sheets is post processed.

14. The sheet post-process apparatus according to claim 13, wherein the processing tray holds the other sheets forming the bundle of sheets that are conveyed via the conveying path without being conveyed to the waiting tray before the bundle of sheets is post-processed.

15. The sheet-post process apparatus according to claim 14, further comprising a post-process mechanism that performs a post-process on the bundle of sheets on the processing tray.

16. The sheet post-process apparatus according to claim 15, further comprising a storage tray which holds the bundle of sheets post-processed by the post-process mechanism and conveyed from the processing tray.

17. A method for post-processing sheets, comprising:

receiving sheets from a multi-function peripheral;

conveying the sheets forward;

holding some of the sheets conveyed from the multi-function peripheral when a bundle of sheets needs to be post-processed on a waiting tray integrally formed with upper and lower alignment members and bottom portions;

aligning the held sheets with the upper alignment members and the bottom portions, wherein the held sheets lie substantially parallel to the bottom portions and substantially perpendicular to the upper alignment members;

opening and closing the waiting tray in a transverse direction orthogonal to a sheet conveying direction with a rack and pinion mechanism to convey the held sheets on the waiting tray to a processing tray;

aligning the conveyed sheets from the waiting tray to the processing tray with the lower alignment members.

* * * * *